US011117041B2

(12) United States Patent
Lopez et al.

(10) Patent No.: US 11,117,041 B2
(45) Date of Patent: Sep. 14, 2021

(54) CATCHER'S MITT AND RELATED METHODS OF USE

(71) Applicant: WETSU SPORTS LLC, Jefferson City, MO (US)

(72) Inventors: Joseph Douglas Lopez, Jefferson City, MO (US); Jason Ryan Jett, Jefferson City, MO (US)

(73) Assignee: WETSU SPORTS LLC, Jefferson City, MO (US)

( * ) Notice: Subject to any disclaimer, the term of this patent is extended or adjusted under 35 U.S.C. 154(b) by 74 days.

(21) Appl. No.: 15/997,890

(22) Filed: Jun. 5, 2018

(65) Prior Publication Data

US 2019/0366192 A1 Dec. 5, 2019

(51) Int. Cl.

| | |
|---|---|
| ***A63B 71/14*** | (2006.01) |
| ***A63B 63/00*** | (2006.01) |
| ***A63B 69/00*** | (2006.01) |

(52) U.S. Cl.

CPC ..... *A63B 71/143* (2013.01); *A63B 63/00* (2013.01); *A63B 2069/0006* (2013.01)

(58) Field of Classification Search

CPC ..... A63B 71/143; A63B 63/00; A63B 2069/0006

See application file for complete search history.

(56) References Cited

U.S. PATENT DOCUMENTS 2,662,225 A * 12/1953 Wheeler ..... A63B 71/143 2/19

3,898,696 A 8/1975 Campanis (Continued)

OTHER PUBLICATIONS

Drelie Gelasca, E., Tomasic, D., Ebrahimi, T., Which Colors Best Catch Your Eyes: a Subjective Study of Color Saliency, First International Workshop on Video Processing and Quality Metrics for Consumer Electronics, Scottsdale, Arizona, USA, 2005.

*Primary Examiner* — Katherine M Moran
*Assistant Examiner* — Erick I Lopez
(74) *Attorney, Agent, or Firm* — Cardle Patent Law CHTD

(57) ABSTRACT

In various aspects, the catcher's mitt disclosed herein may include a catching side defining a thumb edge and a finger edge and a rear side opposed in spaced relation to the catching side with opposing edges of the catching side and rear side interconnected to form a thumb edge, a finger edge, a heel, and a tip. A hand cavity is formed within that comprises a palm cavity, a thumb cavity, and a finger cavity, with the thumb cavity extends generally along the thumb edge and the finger cavity extends along the finger edge, in various aspects. The hand cavity opens at the heel for insertion of at least portions of a hand therein, in various aspects. In various aspects, webbing extends between portions of the thumb edge and the finger edge proximate the tip, and a pocket is formed in the catching side and extending from adjacent the heel toward the tip and overlying at least portions of the palm cavity. In various aspects, the catcher's mitt includes a target formed into the leather on the catching side with the target and portions of the non-target portion of the catching side proximate the target and exclusive of the webbing being formed of a single uninterrupted piece of leather. The target is formed of one or more colors that contrast with a background color of the non-target portion of the catching side to visually attract a pitcher's eye. This Abstract is presented to meet requirements of 37 C.F.R. § 1.72(b) only. This Abstract is not intended to identify key elements of the apparatus and methods disclosed herein or to delineate the scope thereof.

12 Claims, 2 Drawing Sheets

(56) References Cited

U.S. PATENT DOCUMENTS

| | | | | |
|---|---|---|---|---|
| 4,235,042 | A | 11/1980 | Hills | |
| 4,360,206 | A | 11/1982 | Bian | |
| 4,497,485 | A | 2/1985 | Macosko | |
| 4,541,126 | A | 9/1985 | Howard | |
| 4,781,376 | A | 11/1988 | Barnes, Sr. | |
| 4,836,554 | A | 6/1989 | Robbins | |
| 4,863,239 | A | 9/1989 | Malone | |
| 5,113,530 | A | 5/1992 | Smith | |
| D419,728 | S | 1/2000 | Anderson | |
| 6,322,461 | B1 | 11/2001 | Walsh | |
| 6,353,931 | B1 | 3/2002 | Gilligan | |
| 6,669,582 | B1 | 12/2003 | Beeler | |
| 7,479,075 | B2 | 1/2009 | Burruss, Jr. | |
| D649,207 | S | 11/2011 | Hoffman | |
| 8,065,744 | B2 | 11/2011 | Mango | |
| 8,579,734 | B2 | 11/2013 | Stemle | |
| 8,668,604 | B2 | 3/2014 | Stemle | |
| D702,890 | S | 4/2014 | Hedeen, Jr. | |
| D706,991 | S | 6/2014 | Jennings | |
| 2002/0049103 | A1 | 4/2002 | Treihart | |
| 2006/0089214 | A1 | 4/2006 | Cracolici | |
| 2006/0218689 | A1 | 10/2006 | Brown | |
| 2007/0257439 | A1* | 11/2007 | Bolton | A63B 63/00 273/381 |
| 2009/0077705 | A1 | 3/2009 | Gilligan, IV | |
| 2010/0071108 | A1 | 3/2010 | Plocher | |
| 2011/0107493 | A1* | 5/2011 | Watson | A63B 71/143 2/19 |
| 2013/0185838 | A1 | 7/2013 | Newman | |

* cited by examiner

CATCHER'S MITT AND RELATED METHODS OF USE

BACKGROUND OF THE INVENTION

Field

The present disclosure relates to the field of baseball, and, more particularly to a catcher's mitt.

Background

Games of baseball, as used herein, include games as played according to rules set forth, for example, by the Commissioner for Major League Baseball, the International Baseball Federation, National Collegiate Athletic Associations, and National Federation of High School Associations and Little League® Baseball and/or Softball. Games of baseball, as used herein, include games played according to rules set forth, for example, by the Amateur Softball Association or the World Baseball Softball Confederation. Games of baseball, as used herein, include other baseball like games.

A baseball, as used herein, includes a sphere formed by yarn wound around a small core of cork, rubber or similar material, covered with two strips of white horsehide or cowhide, tightly stitched together and weighting not less than 5 ounces avoirdupois nor more than 5 ¼ ounces avoirdupois and measuring not less than 9 inches nor more than 9 ¼ inches in circumference. A baseball, as used herein, includes softballs, such as softballs having a diameter of 3.5 inches, a diameter of 3.8 inches, or a circumference of 16 inches (Chicago style). A baseball, as used herein, includes other balls as may be used in various other baseball like games.

In games of baseball, certain positions are referred to as target positions because other players throw to the target positions. Target positions may include catcher, first base, second base, and shortstop. In particular, pitcher(s) for each side may throw 140 pitches or more per game to the catcher, the catcher being the player positioned behind home plate to catch the baseball thrown by the pitcher.

A catcher's mitt is worn by the catcher, and the catcher uses the catcher's mitt to catch the baseball thrown by the pitcher. The pitcher may throw a variety of types of pitches having a variety of speeds and trajectories usually within a strike zone that varies depending upon the physique of a batter. Throwing such a number and variety of pitches consistently within a somewhat varying strike zone requires concentration on the part of the pitcher. The pitcher may be distracted by players on base and various other game situations that may diminish concentration. Aiding the concentration and focus of the pitcher may be an important consideration.

A relief pitcher must sometimes warm up quickly prior to being called into a game. The warm up may include gaining the concentration as well as loosening muscles and joints in order to throw various types of pitches accurately within the strike zone. Helping the relief pitcher warm up in order to enter the game may be important.

A pitcher may train for years in honing the pitching craft, working on velocity, speed, types of pitches, and delivery. The importance of training aids that may assist in developing the pitching craft has long been recognized.

The need for improvements to the catcher's mitt that improves pitching accuracy has been recognized. However, various proposed improvements to the catcher's mitt suffer from certain deficiencies. Some proposed improvements may be banned from regulation play, for example, due to the potential to aid the catcher rendering the catcher's mitt illegal. Other proposed improvements may alter the behavior of the catcher's mitt, for example, introducing unpredictability into the way the catcher's mitt plays.

Accordingly, there remains a need for improved catchers' mitts as well as related methods of use.

BRIEF SUMMARY OF THE INVENTION

These and other needs and disadvantages may be overcome by the apparatus disclosed herein. Additional improvements and advantages may be recognized by those of ordinary skill in the art upon study of the present disclosure.

A catcher's mitt is disclosed herein. In various aspects, the catcher's mitt may include a catching side defining a thumb edge and a finger edge and a rear side opposed in spaced relation to the catching side with opposing edges of the catching side and rear side interconnected to form a thumb edge, a finger edge, a heel, and a tip. A hand cavity is formed within that comprises a palm cavity, a thumb cavity, and a finger cavity, with the thumb cavity extending generally along the thumb edge and the finger cavity extends along the finger edge, in various aspects. The hand cavity opens at the heel for insertion of at least portions of a hand therein, in various aspects. In various aspects, webbing extends between portions of the thumb edge and the finger edge proximate the tip, and a pocket is formed in the catching side and extending from adjacent the heel toward the tip and overlying at least portions of the palm cavity. In various aspects, the catcher's mitt includes a target formed into the leather on the catching side with the target and portions of the non-target portion of the catching side proximate the target and exclusive of the webbing being formed of a single uninterrupted piece of leather. The target is formed of one or more colors that contrast with a background color of the non-target portion of the catching side to visually attract a pitcher's eye and localize the pitcher's focus to improve performance.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

Figure 1A:
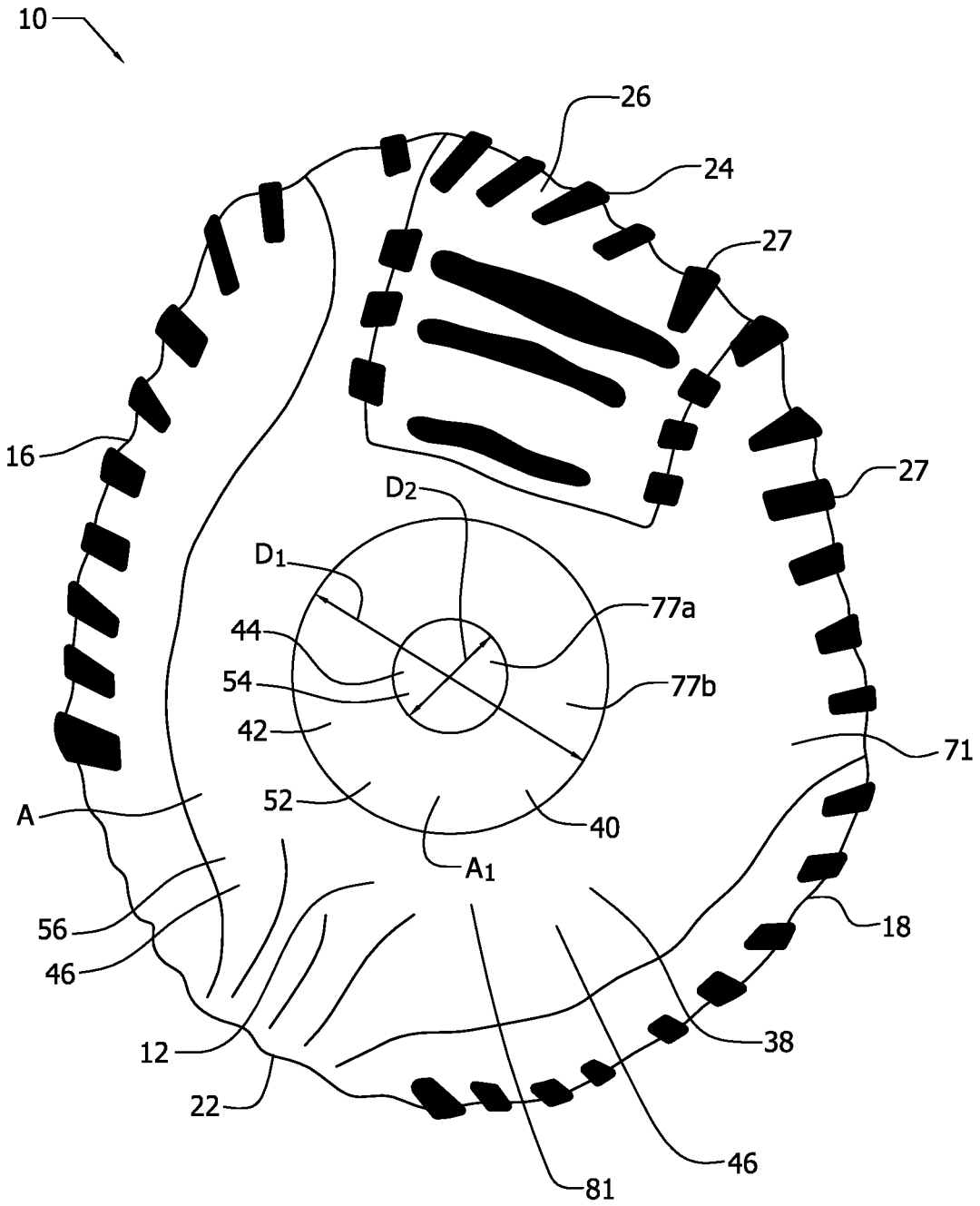
FIG. 1A illustrates by frontal perspective view an exemplary implementation of a catcher's mitt including a catching side thereof in accordance with the present inventions; and, FIG. 1B illustrates by an opposing perspective view at least portions of a rear side of the exemplary implementation of the catcher's mitt of FIG. 1A.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom,"

"right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances such as ±0.1%, ±1%, ±2.5%, ±5%, or other such tolerances, as would be recognized by those of ordinary skill in the art upon study of this disclosure.

DETAILED DESCRIPTION OF THE INVENTION

A catcher's mitt is disclosed herein. In various aspects, a catching side of the catcher's mitt includes a generally circular, high color contrast visual (target) that provides a point of focus for a pitcher in order to aid in the improvement of pitching accuracy. The target is formed into the leather of the catcher's mitt without changing the mechanics of the catcher's mitt, in various aspects. The target does not provide an assist device to the catcher that may be illegal under various rules of the game of baseball, nor does the target restrict the ability of the catcher, for example, by changing the mechanics of the catcher's mitt, in various aspects. The target, in various aspects, is formed to provide contrast and color as well as size and position that attracts the eye of the pitcher.

Figure 1B:
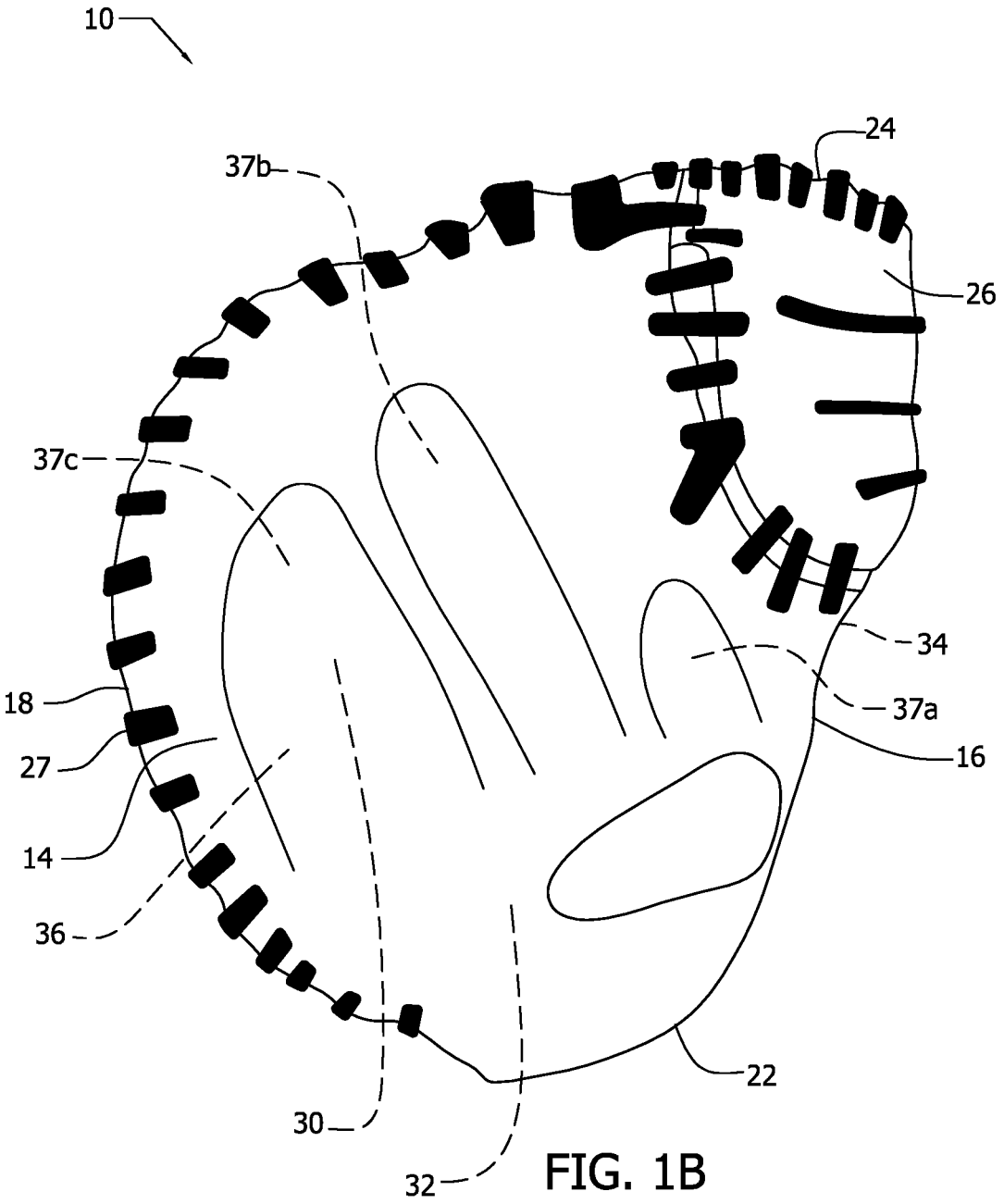

As illustrated in FIGS. 1A and 1B of the drawing, a catcher's mitt 10 having a catching side 12 and an opposed rear side 14 spaced from the catching side 12, with both the catching side 12 and the rear side 14 being constructed of leather 71. Opposing edges of the catching side 12 and rear side 14 are interconnected by lacing 27 including stitching, lacing, or combinations thereof, to form a thumb edge 16 and a finger edge 18 with the thumb edge 16 and the finger edge 18 being spaced relatively wide apart from one another, as illustrated by exemplary catcher's mitt 10. The thumb edge 16 and finger edge 18 extend substantially from the heel 22 to the tip 24 of the catcher's mitt 10. The tip 24 includes webbing 26 that extends between portions of thumb edge 16 and finger edge 18 proximate tip 24, as illustrated. Webbing 26 may be constructed, for example, of two plies of standard leather 71 to close the crotch area entirely, or webbing 26 may be constructed of a series of tunnels made of leather 71, or a series of panels of leather 71, or of lacing leather 71 thongs. Lacing 27 may be formed, at least in part, of one piece of rawhide that may be as much as 80 to 90 inches in length. Lacing 27 may begin at the thumb or little finger, and lacing 27 holds catcher's mitt 10 together. Catching side 12 exclusive of webbing 26 and lacing 27 may be formed as a unitary piece of leather that consists only of dyed leather.

Hand cavity 30 is interposed between the catching side 12 and rear side 14 of catcher's mitt 10 to receive at least portions of the catcher's hand therein, as illustrated in FIG. 1B. Hand cavity 30 opens at heel 22 for insertion of portions of the catcher's hand therein with the palm of the hand oriented toward catching side 12, as illustrated. With the catcher's hand received within hand cavity 30, a baseball may be caught by the catcher using the catching side 12 of the catcher's mitt 10, as would be readily recognized by those of ordinary skill in the art upon study of this disclosure. Padding (not shown) may be provided between catching side 12 and rear side 14 particularly about hand cavity 30 to cushion the impact of the baseball on the catcher's hand within hand cavity 30.

Note that exemplary catcher's mitt 10, as illustrated, is designed to be worn on the catcher's left hand. A reversal of the construction of exemplary catcher's mitt 10 illustrated in the Figures may be utilized for a catcher's mitt intended to be worn on the catcher's right hand, as would be readily recognized by those of ordinary skill in the art upon study of this disclosure.

As illustrated in FIG. 1B, hand cavity 30 includes a palm cavity 32 that receives the body of the catcher's hand. Hand cavity 30 further includes a thumb cavity 34 that extends generally along the thumb edge 16 and finger cavity 36 that extends generally along the finger edge 18 to receive the catcher's thumb and to receive one or more of the catcher's fingers, respectively. Finger cavity 36 is located on the opposite side of the webbing 26 from the thumb cavity 34. The finger cavity 36 may be formed in various ways to receive one or more of the catcher's fingers depending upon the preference of the catcher. In this implementation, the finger cavity 36 is divided into three segments 37*a*, 37*b*, 37*c* that receive the index finger, the middle finger, and the ring finger along with the little finger, respectively. Finger cavity 36 may have other constructions to receive the fingers such as the index finger in a segment, such as segment 37*a*, the middle finger in combination with ring finger in a segment, such as segment 37*b*, and the little finger in a segment, such as segment 37*c*. Some catchers may, for example, prefer to keep their index finger outside of segment 37*a* when using catcher's mitt 10, and thus, in some implementations, segment 37*a* of finger cavity 36 may be omitted. Yet other implementations may include four segments similar to segments 37*a*, 37*b*, 37*c*—one segment for each finger.

Overlying at least the palm cavity 32 portion of the hand-receiving cavity 30 on catching side 12 is pocket 38 that extends from adjacent the heel 22 of the catching side 12 of catcher's mitt 10 toward tip 24. Pocket 38 may be sized and shaped to facilitate catching the baseball by the catcher, and padding may be used at least in part to form the pocket 38 and otherwise contour the catching side 12.

Catching side 12 has surface area A, and catching side 12 includes target 40 positioned on catching side 12 to encompass at least portions of pocket 38, as illustrated in FIG. 1A. Target 40 may encompass at least portions of webbing 26, in certain implementations. Target 40 may be positioned on catching side 12 to be visible to a pitcher when the finger edge 18 is faced toward the pitcher. Target 40 is formed as a circle 44 of circle diameter $D_2$ positioned symmetrically within annulus 42 with annulus having annulus diameter $D_1$, as illustrated in FIG. 1A. In other implementations, target 40 may be of elliptical shape, polygonal shape, or other geometric shape or may include elements similar to annulus 42 and circle 44 but having various other geometric shapes in accordance with the teachings disclosed herein.

According to a visual attention model, regions covered between 10-20% of the surface frame were most significant. (see Drelie Gelasca, E., Tomasic, D., Ebrahimi, T., *Which Colors Best Catch Your Eyes: a Subjective Study of Color Saliency*, First International Workshop on Video Processing and Quality Metrics for Consumer Electronics, Scottsdale, Ariz., USA, 2005, hereby incorporated by reference herein) According to the visual attention model, red coloration surpassed all other coloration by over 30% in influencing rapid and task-independent scanning of an image by a human observer and was, thus, deemed the most salient color with the highest level of optical annoyance. Yellow, safety green, and pink were found to be salient colors according to the visual attention model.

Based upon this visual attention model, annulus diameter $D_1$ is selected so that generally:

$$10\% \leq A_1/A \times 100 \leq 20\% \quad (1)$$

where $A_1 = \pi D_1^2/4$ the target area bounded by annulus diameter $D_1$, in various implementations. The ratio of circle diameter to annulus diameter $D_1/D_2$ may be selected to provide visual contrast between annulus 42 and circle 44 in order to increase the visibility of circle 44 either alone or in combination with annulus 42, and thus increase the visibility of target 40.

EXAMPLE

A Model Mizuno Pro GMP200 Limited Edition Catcher's Mitt 33.5" (Right Handed Throw) 309.00 Mizuno pMizuno Pro Limited catcher's mitt made by Mizuno Corporation of Osaka, Japan has a circumference of 33.5 inches. Modelling this Mizuno Pro GMP200 mitt as generally circular, the catching side is calculated to have an area A≈89.4 sq. inches. Using exemplary annulus diameters $D_1$=4 inches results in area ratio $A_1/A \approx 0.14$ or the target covers about 14% of the catching side of the catcher's mitt. Using an exemplary circle diameter $D_2$=1.75 inches results in ratio $D_1/D_2$=0.4375.

Non-target portions 46 of catching side 12 (i.e. catching side 12 exclusive of target 40) has background color 56 that may be generally a single color that may range from light tan to dark tan to black, depending upon the processing of the leather 71 of which catching side 12 is made. Thus, background color 56 of non-target portions 46 of catching side 12 may be relatively dull color and may be substantially non-reflective.

Circle color 54 of circle 44 may be selected to apprehend the eye, and, thus, circle color may be selected, for example, from red, yellow, safety green, safety yellow, pink, and combinations thereof based upon the above reference visual attention model.

Annulus color 52 of annulus 42 may be selected to contrast with circle color 54, contrast with background color 56, or contrast with both circle color 54 and background color 56. In some implementations, annulus color 52 may be white, while, in other implementations, annulus color 52 may be selected as a color or combination of colors that provides visual contrast with circle color 54 or that highlights circle color 54. Circle color 54, annulus color 52, or both circle color 54 and annulus color 52 may be patterned, for example, by being organized into stripes, waves, lines, blocks (e.g., checkerboard) that may involve color variations, multiple colors, or contrasting colors, in various implementations.

Catcher's mitt 10 is substantially hand assembled from four parts—catching side 12, pad, rear side 14, and webbing 26 that are die-cut from a hide, in various implementations. During assembly of catcher's mitt 10, the catching side 12 and rear side 14 are sewn together first, and then joined together with the other pieces while inside out to form a shell (not shown). The shell is then wetted or steamed for flexibility and then turned right side out to form a turned shell. The turned shell is then placed on a hot hand, which is a hand shaped heated metallic last, to help form the turned shell into the correct size and ensure that finger openings are open for insertion of fingers therein. One or more pads are then inserted within the turned shell, and catcher's mitt 10 may include five pads for cushioning, in various implementations. Lacing 27 is then added as the assembly of catcher's mitt 10 is completed to secure parts of catcher's mitt 10 together.

Target 40 may be formed into leather 71 during an origination process of leather 71 and dyeing of the leather 71, in some implementations, before leather 71 is die-cut. In other implementations, target 40 may be formed during the assembly of catcher's mitt 10. Target 40 may be formed of dye 77*a*, 77*b* in combination with leather 71 of catching side 12, as illustrated in FIG. 1A. Per this exemplary implementation, dye 77*a* imparts circle color 54 and dye 77*b* imparts annulus color 52 to leather 71. Thus, at least portions of non-target portion 46 of the catching side 12 proximate target 40 and exclusive of webbing 26 are formed of a single uninterrupted piece 81 of leather 71 that is continuous with the leather 71 of target 40, in various implementations. That is, target 40 and at least portions of non-target portion 46 of catching side 12 proximate target 40 are formed of a single uninterrupted piece 81 of leather 71, in various implementations. Dye 77*a*, 77*b* may include, for example, mordant dyes, substantive dyes, spirit stains, and combinations thereof that may absorb into leather 71. Exemplary dye 77*a*, 77*b* that may form target 40 may be manufactured, for example, by Fiebing Company, Inc. of Milwaukee, Wis. Leather 71 of catcher's mitt 10 including target 40 may be cleaned, for example, with leather soap and other conventional cleaning materials and related methods of use.

Because dye 77*a*, 77*b* absorbs into leather 71 to color leather 71, target 40 may not alter substantively the mechanics of leather 71. In various implementations, no sticker, no barriers within leather 71, no non-leather components other than dye 77*a*, 77*b* are used to form target 40—i.e., target 40 is formed solely of dyed leather. No plastic, paper, or other non-leather materials are used to form target 40, in various implementations. Accordingly, target 40 may not constitute an assist device that violates certain rules of baseball.

For example, "[t]he catcher may wear a leather mitt not more than thirty-eight inches in circumference, nor more than fifteen and one-half inches from top to bottom." (Rule 3.04 (1.12) Catcher's Mitt, Official Baseball Rules 2017 Edition, Office of the Commissioner of Baseball; emphasis added) Thus, the addition of a sticker, inclusion of non-leather barriers or non-leather components or materials within or about the surface of a mitt including in or about the catching side may cause such a mitt to violate the leather mitt requirement of Rule 3.04, while target 40 may be allowable according to Rule 3.04 because target 40 is formed of leather 71 dyed by dyes 77*a*, 77*b*.

In operation, a catcher dons the catcher's mitt, such as catcher's mitt 10. The catcher may then orient a catching side, such as catching side 12, toward a pitcher such that at least portions of a target, such as target 40, formed on the catching side are displayed to the pitcher. The catcher may position the target at a location that the battery—the pitcher and catcher—desires to direct the pitcher to throw the baseball to. The pitcher then visually apprehends the target, and uses this visual apprehension of the target as an aid in throwing the baseball to the location indicated by the target. The pitcher may focus attention on the target when throwing the baseball, and the target may command the pitcher's attention increasing the pitcher's accuracy. The target may be displayed, at least in part, to the pitcher momentarily (flashed) during the pitching process, in some implementations, while, in other implementations of the pitching process, the target is continuously displayed to the pitcher. The target may be displayed to the pitcher when the finger edge is faced toward the pitcher, in some implementations.

The foregoing discussion along with the Figures discloses and describes various exemplary implementations. These implementations are not meant to limit the scope of coverage, but, instead, to assist in understanding the context of the language used in this specification and in the claims. Upon study of this disclosure and the exemplary implementations herein, one of ordinary skill in the art may readily recognize that various changes, modifications and variations can be made thereto without departing from the spirit and scope of the inventions as defined in the following claims.

The invention claimed is:

1. A catcher's mitt, comprising:

a catching side consisting of dyed leather exclusive of lacing and a webbing;

a rear side opposed in spaced relation to the catching side, opposing edges of the catching side and rear side interconnected to form a thumb edge, a finger edge, a heel, and a tip, the webbing extending between portions of the thumb edge and the finger edge proximate the tip;

a hand cavity disposed between the catching side and the rear side, the hand cavity comprising a palm cavity, a thumb cavity, and a finger cavity, the thumb cavity extends generally along the thumb edge and the finger cavity extends along the finger edge, the hand cavity opens at the heel for insertion of at least portions of a hand therein;

a pocket formed in the catching side and extending from adjacent the heel toward the tip and overlying at least the palm cavity;

a target formed at least in part into a portion of the catching side exclusive of lacing and the webbing, the target having a target color; and a non-target portion comprising a remainder of the catching side exclusive of the target and exclusive of lacing and the webbing, the non-target portion having a background color that differs from the target color.

2. The apparatus of claim 1, wherein the target is positioned in at least portions of the pocket.

3. The apparatus of claim 1, wherein the background color is selected from a group consisting of tan and black.

4. The apparatus of claim 1, the target positioned on the catching side to be visible at least in part to a pitcher when the finger edge is faced toward the pitcher.

5. The apparatus of claim 1, the target comprising:

a circle having a circle color; and an annulus surrounding the circle the annulus having an annulus color that differs from the circle color.

6. The apparatus of claim 5, the circle color comprises red.

7. The apparatus of claim 5, the circle color is selected from a group consisting of red, yellow, safety green, and pink.

8. The apparatus of claim 5, the annulus color comprises white.

9. The apparatus of claim 5, the diameter of the circle $D_2$ being half of the annulus diameter $D_1$.

10. The apparatus of claim 1, the target area $A_1$ of the target being between 10% and 20% of the surface area A of the catching side.

11. A method of aiding a pitcher, comprising the steps of:

focusing by said pitcher upon a target on a catching side of a catcher's mitt worn by a catcher, the catching side exclusive of lacing and a webbing consisting of dyed leather, the catcher's mitt having a rear side opposed in spaced relation to the catching side with opposing edges of the catching side and rear side interconnected to form a thumb edge, a finger edge, a heel, and a tip with the webbing extending between portions of the thumb edge and the finger edge proximate the tip, the catcher's mitt having a hand cavity disposed between the catching side and the rear side, the hand cavity comprising a palm cavity, a thumb cavity, a finger cavity, the thumb cavity extending generally along the thumb edge and the finger cavity extending along the finger edge, the hand cavity opening at the heel for inserting of at least portions of a hand therein, the catcher's mitt having a pocket formed in the catching side, the pocket extending from adjacent the heel toward the tip and overlying at least the palm cavity, the target being formed at least in part on the catching side exclusive of lacing and the webbing, the target having a target color contrasting with a background color of a non-target portion comprising a remainder of the catching side exclusive of lacing and the webbing; and throwing a baseball toward the target by said pitcher.

12. The method of claim 11, the target area $A_1$ of the target being generally between about 10% and about 20% of the surface area A of the catching side.

* * * * *